US007188838B2

(12) United States Patent
Jones et al.

(10) Patent No.: US 7,188,838 B2
(45) Date of Patent: Mar. 13, 2007

(54) CARD GAME

(76) Inventors: Lorraine W. Jones, 16100 Barnesville Rd., Boyds, MD (US) 20841; Joseph M. Jones, 16100 Barnesville Rd., Boyds, MD (US) 20841

( * ) Notice: Subject to any disclaimer, the term of this patent is extended or adjusted under 35 U.S.C. 154(b) by 308 days.

(21) Appl. No.: 11/034,726

(22) Filed: Jan. 14, 2005

(65) Prior Publication Data

US 2006/0157931 A1 Jul. 20, 2006

(51) Int. Cl.
*A63F 1/00* (2006.01)

(52) U.S. Cl. ..... 273/274; 273/292

(58) Field of Classification Search ..... 273/274, 273/292, 309; 463/12, 13
See application file for complete search history.

(56) References Cited

U.S. PATENT DOCUMENTS

| | | | | |
|---|---|---|---|---|
| 5,067,724 | A | 11/1991 | Rinkavage | |
| 5,489,101 | A | 2/1996 | Moody | |
| 5,725,216 | A | 3/1998 | Jones | |
| 5,762,340 | A | 6/1998 | Feola | |
| 5,785,593 | A | 7/1998 | Wood et al. | |
| 5,803,809 | A | 9/1998 | Yoseloff | |
| 5,810,354 | A | 9/1998 | Banyai | |
| 6,070,873 | A * | 6/2000 | Perkins | 273/292 |
| 6,752,394 | B2 * | 6/2004 | Malcolm | 273/292 |
| 6,755,421 | B1 | 6/2004 | Aftergood | |
| 6,811,153 | B1 * | 11/2004 | Ko | 273/292 |
| 7,140,614 | B2 * | 11/2006 | Snow | 273/274 |
| 2002/0008356 | A1 | 1/2002 | De Keller | |
| 2003/0006555 | A1 | 1/2003 | Boylan et al. | |
| 2003/0022709 | A1 | 1/2003 | Awada | |
| 2003/0155713 | A1 | 8/2003 | Jones et al. | |
| 2003/0214097 | A1 | 11/2003 | Moody | |

(Continued)

FOREIGN PATENT DOCUMENTS

EP 1145743 A2 10/2001

(Continued)

OTHER PUBLICATIONS

"Draw Poker Variants," website: http://www.pokernews.info/poker-variants/drawpoker.html#5CardDraw.

(Continued)

*Primary Examiner*—William M. Pierce
(74) *Attorney, Agent, or Firm*—Christopher Wood; Wood and Eisenberg, PLLC

(57) ABSTRACT

A method of playing a card game includes the steps of: providing n number of cards from a deck of cards to each player; requiring each player to select and remove x number of cards from their n number of cards to make a card hand of x number of selected cards and n−x number of unselected cards; requiring each player to discard their unselected cards to provide a pile of unselected cards; turning each card in the pile face up; allowing each player in turn to swap one card from their card hand for one card from the pile of face up unselected cards, or to pass, until each player has decided to stay with their card hand; requiring each player to reveal their card hand; and determining the winning card hand by a predetermined set of rules. Additionally, providing a community card may be included in the method.

20 Claims, 4 Drawing Sheets

U.S. PATENT DOCUMENTS

| | | | |
|---|---|---|---|
| 2004/0023706 | A1 | 2/2004 | Hunter et al. |
| 2004/0036217 | A1 | 2/2004 | Schlumbrecht |
| 2004/0075214 | A1 | 4/2004 | Roberts |
| 2004/0075216 | A1 | 4/2004 | Moody |
| 2004/0090005 | A1 | 5/2004 | Snow |
| 2004/0183256 | A1 | 9/2004 | Ko |

FOREIGN PATENT DOCUMENTS

| | | | |
|---|---|---|---|
| GB | 2362836 | A | 12/2001 |
| WO | WO 98/50120 | A1 | 11/1998 |
| WO | WO 99/64128 | A1 | 12/1999 |

OTHER PUBLICATIONS

"The Five-Suited Deck of Playing Cards," website: http://www.stardeck.com/.
"Miscellaneous Poker Variants," website: http://www.pokernews.info/poker-variants/miscellaneous.html.
"Shared-Card Poker Variants," website: http://www.pokernews.info/poker-variants/shared-card-poker.html.
"Stud Poker Variants," website: http://www.pokernews.info/poker-variants/studpoker.html.

* cited by examiner

CARD GAME

CROSS-REFERENCE TO RELATED APPLICATIONS

Not Applicable.

STATEMENT REGARDING FEDERALLY SPONSORED RESEARCH OR DEVELOPMENT

Not Applicable.

FIELD OF THE INVENTION

The present invention relates generally to card games and poker card games. More specifically, the present invention is directed to a method of playing a card game, such as, but is not limited to, a variation of a traditional poker game.

BACKGROUND OF THE INVENTION

There are many known card games and poker card games, including the traditional Five Card Stud, Seven Card Stud, Five Card Draw, Seven Card Draw, and many other variations of the traditional poker game, that provide amusement and potential employment, if a card game is played in a gaming establishment, e.g., a casino, to people all over the world. Thus, there is a need for an improved and different method of playing a card game, such as, but is not limited to, a variation of a traditional poker game.

The related art of interest describes various card games and poker games that use card decks consisting of fifty-two cards or sixty-five cards, or that are variations of the traditional poker game, but none discloses the present invention.

U.S. Patent Application Publication No. 2004/0036217 A1, published to Schlumbrecht, discloses a flop poker game being played with each player making an ante bet and a pot bet at the start of the game. Each player is dealt three cards face down and the dealer deals three cards to a designated area on the table face down. Each player plays their hand and determines to stay in the hand by making the flop bet to see the flop cards or by folding the hand and surrendering the ante bet to the house and the pot bet to the player's pot. The players that remain in the game see the flop. All cards are revealed at the same time all at once. They use three cards from their hand and any two cards from the flop. No additional wagering is necessary to use the sixth card to make their best five card poker hand. The game concludes with the dealer revealing all players hands to search for the highest value rank of the poker hands on the table. This game uses a standard fifty-two card deck.

U.S. Patent Application Publication No. 2004/0023706 A1, published to Hunter et al., discloses a new, extended card deck and method therefore comprising a standard fifty-two card deck plus at least one set of thirteen separately valued cards (Ace, 2, 3, 4, 5, 6, 7, 8, 9, 10, Jack, Queen, and King) having a new card suit capable of being used in various poker and other card games.

U.S. Pat. No. 6,132,311, issued to Williams, discloses that a player makes one wager to play two or more, and preferably five, hands of five cards each against a pay table and the player attempts to make the highest ranking five card poker hand in each hand. Using a standard deck of fifty-two playing cards, two cards are dealt face up and are the community cards that are common to each hand. The remaining three cards for each hand are dealt face down. The player may discard none, one or both of the face up community cards and receives replacement cards for the discarded cards, if any. The player may double his wager before or after the draw step. When the draw step is completed and the player has doubled his wager or not, the player presses the deal button and the remaining three face down cards are revealed. The community cards are used with each of the partial three card hands to form final five card hands. The player wins on any five card hand that has a preestablished poker hand ranking as shown in the pay table. In one variation, a sixty-five card deck is used which has five thirteen card suits.

U.S. Patent Application Publication No. 2003/0155713 A1, published to Jones et al., discloses a method of playing card games wherein a dealer deals seven cards to each player with all the card dealt face down. The players view their cards and each player has the option to either fold and lose an ante wager or call by making a bet wager exactly twice their ante wager.

Other U.S. patents or patent publications known to the inventor in the field of card games and poker games that use card decks consisting of fifty-two cards or sixty-five cards, or that are variations of the traditional poker game, are:

2002/0008356, 2003/0006555, 2003/0022709, 2003/0155713, 2003/0214097, 2004/0023706, 2004/0036217, 2004/0075214, 2004/0075216, 2004/0090005, 2004/0183256, U.S. Pat. Nos. 5,067,724, 5,489,101, 5,725,216, 5,762,340, 5,785,593, 5,803,809, 5,810,354, 5,845,907, 6,132,311, 6,170,827, 6,379,245, 6,402,147, 6,752,394, and 6,755,421.

Foreign patents or patent publications known to the inventor in the field of card games and poker games are: WO 98/50120 A1, WO 99/64128 A1, EP 1145743 A2, and GB 2362836 A. Other references known to the inventor are: "Draw Poker Variants" (website: http://www.pokernews.info/poker-variants/drawpoker.html#5CardDraw), "The Five-Suited Deck of Playing Cards" (website: http://www.stardeck.com/), "Miscellaneous Poker Variants" (website: http://www.pokernews.info/poker-variants/miscellaneous.html), "Shared-Card Poker Variants" (website: http://www.pokernews.info/poker-variants/shared-card-poker.html), and "Stud Poker Variants" (website: http://www.pokernews.info/poker-variants/studpoker.html).

None of the above patents and publications, taken either singularly or in combination, is seen to describe the instant invention as claimed.

SUMMARY OF THE INVENTION

The present invention is directed to a method of playing a card game, such as, but is not limited to, a variation of a poker game where the ranking order of the players' card hands follow the traditional rules of poker.

According to a first embodiment, the method of playing a card game starting with a deck of cards, includes the steps of:

(a) providing n number of cards from a deck of cards to each of a plurality of players, such that at least one of the n number of cards is provided face down to each player, such that once each player has been provided n number of cards from the deck of cards the remaining cards in the deck of cards are placed aside;

(b) requiring each player to select and remove x number of cards from their n number of cards such that each player ends up with a preferred card hand of x number of selected cards and n−x number of unselected cards;

(c) requiring each player to discard their unselected cards, such that the unselected cards of each player are in the face down position until all players have discarded their unselected cards to provide a pile of unselected cards;

(d) turning each card in the pile of unselected cards face up;

(e) allowing each player in turn to swap one card from their card hand for one card from the pile of face up unselected cards, or to pass (a player in turn can swap on any swapping turn even if that player passed on a previous swapping turn(s)), such that each swapped card remains face down and unused or is turned face up and then treated as an unselected card available for swapping, such that if a player passes the next player is allowed to pass or swap a card;

(f) continuing with step (e) until each player has decided to stay with their card hand;

(g) requiring each player to reveal their card hand; and (h) determining the winning card hand by a predetermined set of rules.

According to a second embodiment, the method of playing a card game differs from the method of the first embodiment in that it further includes step (f') of providing a community card from the remaining deck of cards face up for simultaneous optional use by any or all of the players. Step (f') is performed between steps (f) and (g) of the first embodiment.

According to a third embodiment, the method of playing a card game differs from the method of the second embodiment in that step (g) of the second embodiment is replaced with step (g') of the third embodiment. Step (g') requires the first player in turn to reveal one card at a time from their card hand until one of the cards of the first player has a greater value than the value of the community card. The second player in turn is then required to reveal one card at a time from their card hand until one of the cards of the second player has a greater value than the value of the last revealed card of the first player, wherein step (g') continues until each player in turn has revealed their card hand.

Additionally, if wagering or betting is desired, the method of playing a card game of any of the embodiments further includes at least one step of placing bets.

BRIEF DESCRIPTION OF THE DRAWINGS

Similar reference characters denote corresponding features consistently throughout the attached drawings.

DETAILED DESCRIPTION OF THE PREFERRED EMBODIMENTS

Referring to FIGS. 1–4, the present invention is directed to a method 100*a*,100*b*,100*c* of playing a card game 110, such as, but is not limited to, a variation of a poker game where the ranking order of the players' card hands follow the traditional rules of poker.

The card game 110 of the invention may be played face-to-face with at least one deck of cards 120, or may be played on a forum, such as the internet or worldwide web, a video card game machine, e.g., a video poker machine, a video game device or machine, a communication device, e.g., a cellular telephone, or any other forum known in the art. Also, the card game 110 may be played with any predetermined number of players, such as two to nine players, with or without betting or wagering, and at or on any property or location, such as a home, an airport, a restaurant, a school, a store, or a gaming establishment, e.g., a casino. The number of players that can participate in an individual card game 110 is determined by the number of cards in the deck of cards 120 that are needed to complete the game 110.

The deck of cards 120 preferably consists of sixty-five cards of five different sets or suits, such as stars, dots, diamonds, swirls and rings, with thirteen cards per set or suit. Each card in an individual set or suit has a distinguishable numerical value, such as two, three, four, five, six, seven, eight, nine, ten, Jack, Queen, King or Ace, with corresponding cards in the other suits. The cards in each set or suit are ranked in an ascending order, such as from two to Ace. Alternatively, the deck of cards 120 may consist of the more traditional fifty-two cards, or any other preferred number of cards, and of the traditional suits of spade, club, heart and diamond, or any other preferred group of suits.

Figure 1:
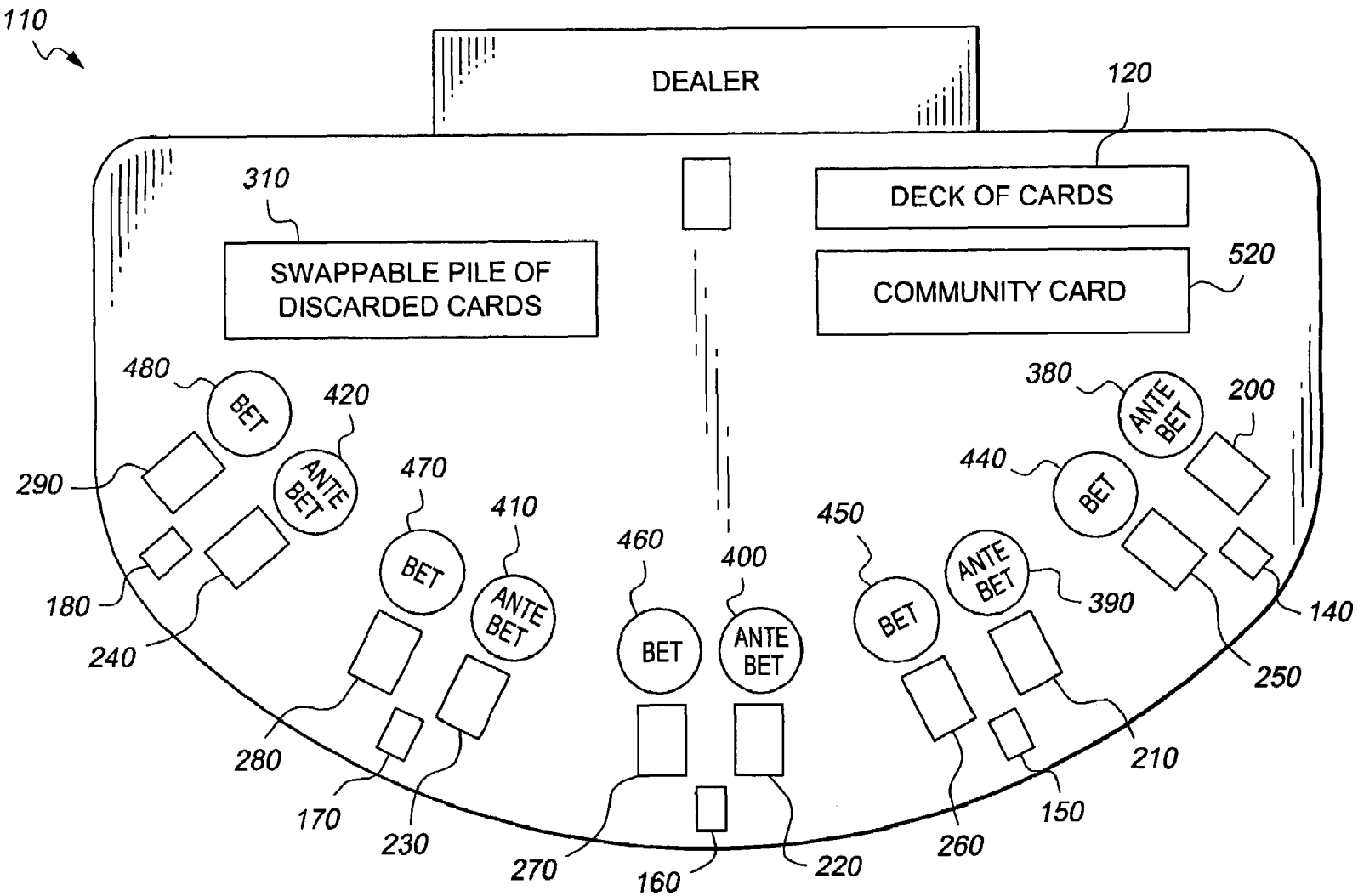
FIG. 1 shows a perspective environmental view of a card game according to the present invention.
Figure 2:
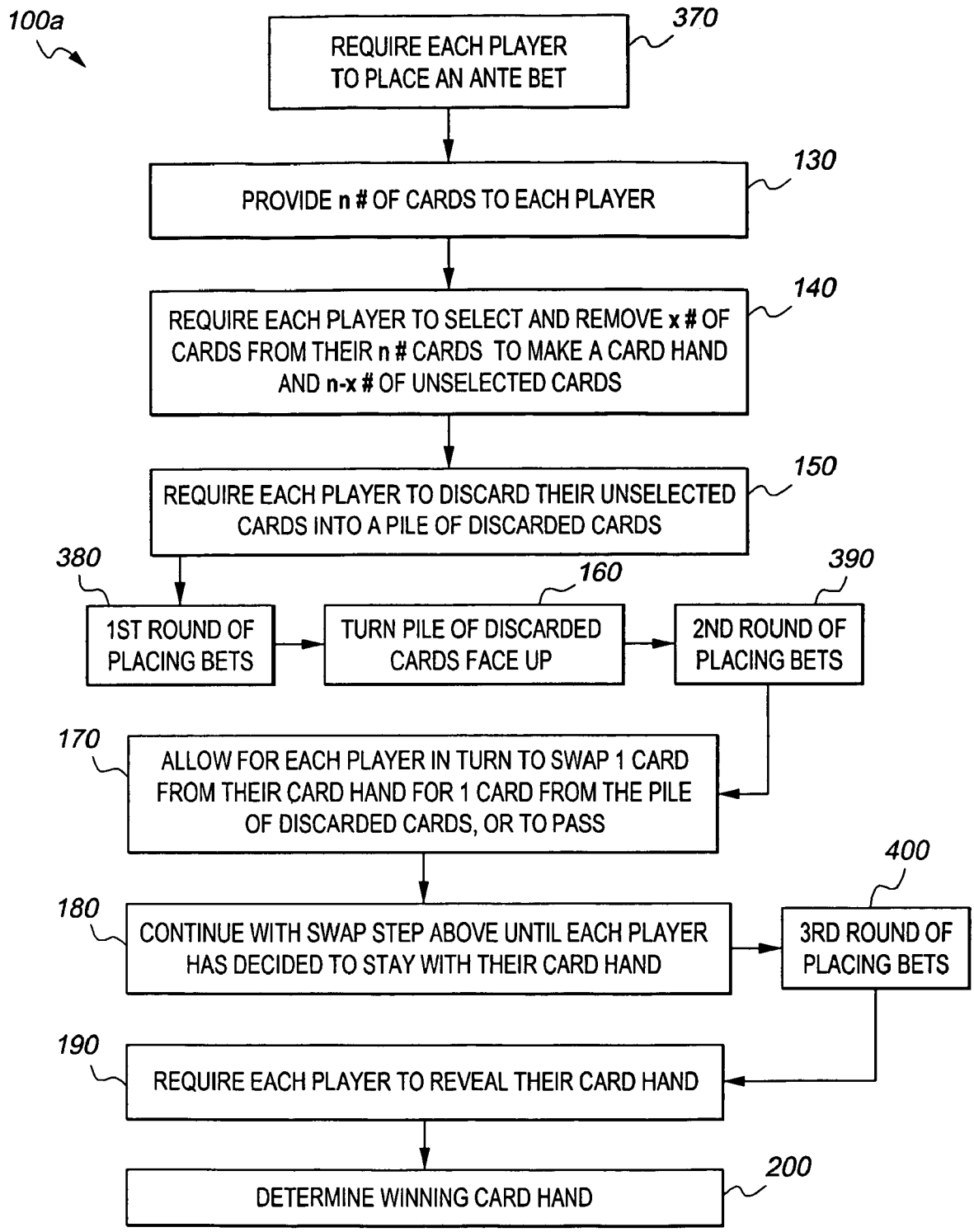
FIG. 2 shows a block diagram of an embodiment of the method of playing a card game, including a plurality of betting steps, according to the present invention.

Referring to FIGS. 1 and 2 and according to a first embodiment, the method 100*a* of playing a card game 110 includes the steps 130,140,150,160,170,180,190,200 of:

(a) providing n number 210,220,230,240,250, preferably seven, of cards from a deck of cards 120, preferably all the cards 210,220,230,240,250 are face down, to each of a plurality of players, such as two to nine players, such that at least one of the n number 210,220,230,240,250 of cards, preferably all seven cards, is provided face down to each player, such that once each player has been provided n number 210,220,230,240,250 of cards from the deck of cards 120 the remaining cards in the deck of cards 120 are placed aside, preferably face down;

(b) requiring each player to select and remove x number 260,270,280,290,300 of cards, such as five, from their n number 210,220,230,240,250 of cards such that each player ends up with a preferred card hand of x number of selected cards 260,270,280,290,300 and n−x number 310,320,330,340,350, such as seven minus five, of unselected cards;

(c) requiring each player to discard their unselected cards 310,320,330,340,350, such that the unselected cards 310, 320 330,340,350 of each player are in the face down position until all players have discarded their unselected cards 310, 320,330,340,350 to provide a pile 360 of discarded cards 310,320,330,340,350;

(d) turning each card in the pile 360 of discarded cards 310,320,330,340,350 face up;

(e) allowing each player in turn to swap one card from their card hand 260,270,280,290,300 for one card from the face up pile 360 of discarded cards 310,320,330,340,350, or to pass (a player in turn can swap on any swapping turn even if that player passed on a previous swapping turn(s)), such that each swapped card remains face down and unused or is turned face up and then treated as an unselected card available for swapping, such that if a player passes the next player is allowed to pass or swap a card;

(f) continuing with step (e) 170 until each player has decided to stay with their card hand;

(g) requiring each player to reveal their card hand; and (h) determining the winning card hand by a predetermined set of rules.

If the card game 110 is a variation of a poker game, the winning card hand of step (h) 200 is preferably determined by a ranking order according to traditional poker rules. In five card poker, the traditional poker hand rankings, from highest to lowest, are a Royal Flush, a Straight Flush, a Four of a Kind, a Full House, a Flush, a Straight, a Three of a Kind, a Two Pair, One Pair, and High Card in the hand.

Additionally, if wagering or betting is desired, the method 100*a* of playing a card game 110 of the first embodiment further includes at least one, preferably most or all, of the steps 370,380,390,400 of:

(i) requiring each player to place an ante bet 410,420, 430,440,450 prior to step (a) 130 for participation in the card game 110;

(j) allowing each player in turn to participate in at least one round of placing bets 460,470,480,490,500 with one another, wherein step (j) 380 is performed between steps (a) 130 and (b) 140, or between steps (b) 140 and (c) 150, or between steps (c) 150 and (d) 160, or to dispose of their card hand and lose at least one, preferably any and all, pending bet 410,420,430,440,450,460,470,480,490,500;

(k) allowing each player in turn to participate in at least one round of placing bets 460,470,480,490,500 with one another, wherein step (k) 390 is performed between steps (d) 160 and (e) 170, or to dispose of their card hand and lose at least one, preferably any and all, pending bet 410,420,430, 440,450,460,470,480,490,500; and (l) allowing each player in turn to participate in at least one round of placing bets 460,470,480,490,500 with one another, wherein step (l) 400 is performed between steps (e) 170 and (f) 180 or between steps (f) 180 and (g) 190, or to dispose of their card hand and lose at least one, preferably any and all, pending bet 410,420,430,440,450,460,470,480, 490,500.

Figure 3:
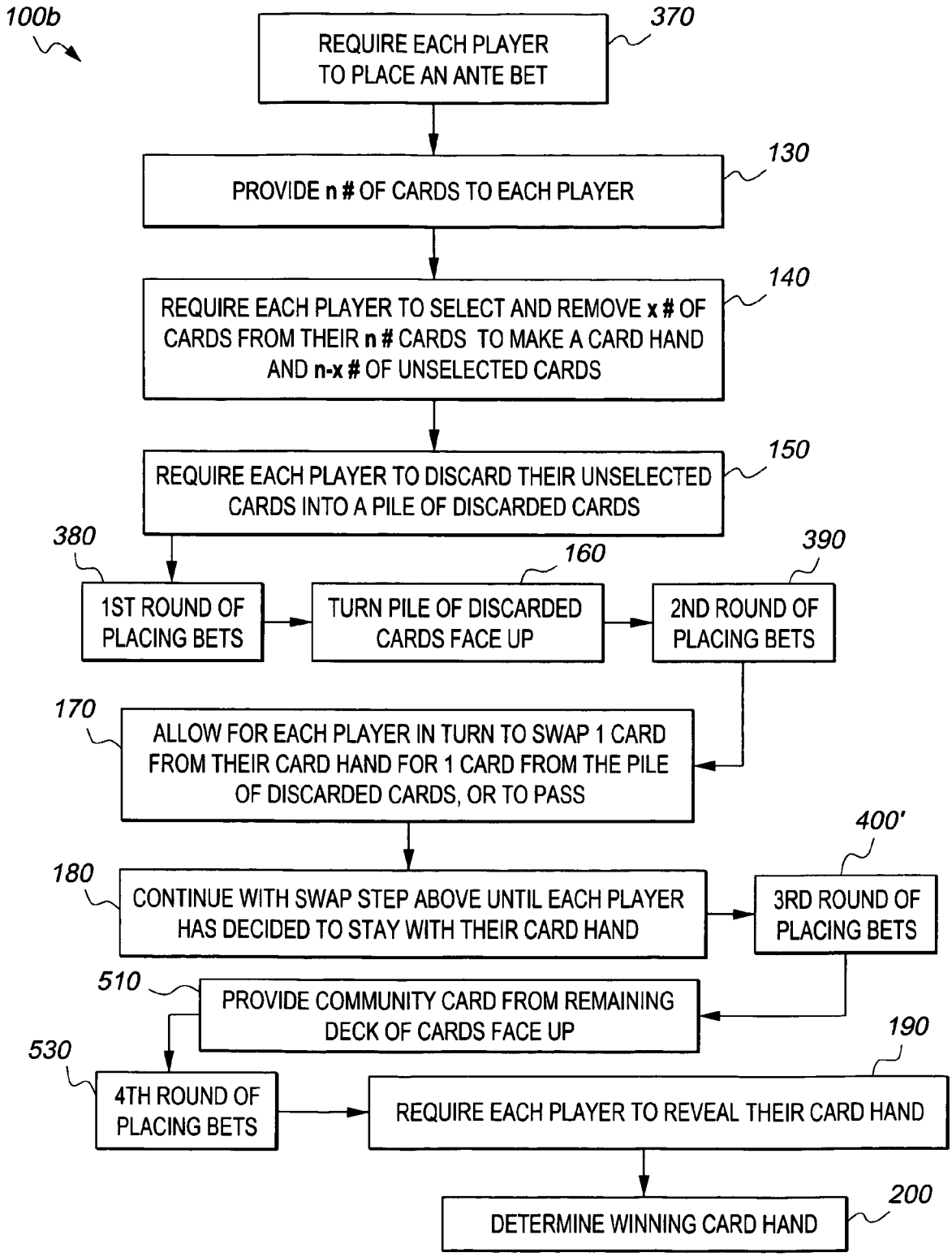
FIG. 3 shows a block diagram of another embodiment of the method of playing a card game, including a plurality of betting steps, according to the present invention.

Referring to FIGS. 1 and 3 and according to a second embodiment, the method 100*b* of playing a card game 110 differs from the method 100*a* of the first embodiment in that it further includes a step (f') 510 of providing a community card 520 from the remaining deck of cards, preferably from the top of the deck, face up for simultaneous optional use by any or all of the players. Step (f') 510 is performed between steps (f) 180 and (g) 190 of the first embodiment.

Thus, if wagering or betting is desired, the method 100*b* of playing a card game 110 of the second embodiment further includes at least one, preferably most or all, of the steps 370,380,390,400',530 of:

(i) requiring each player to place an ante bet 410,420, 430,440,450 prior to step (a) 130 for participation in the card game 110;

(j) allowing each player in turn to participate in at least one round of placing bets 460,470,480,490,500 with one another, wherein step (j) 380 is performed between steps (a) 130 and (b) 140, or between steps (b) 140 and (c) 150, or between steps (c) 150 and (d) 160, or to dispose of their card hand and lose at least one, preferably any and all, pending bet 410,420,430,440,450,460,470,480,490,500;

(k) allowing each player in turn to participate in at least one round of placing bets 460,470,480,490,500 with one another, wherein step (k) 390 is performed between steps (d) 160 and (e) 170, or to dispose of their card hand and lose at least one, preferably any and all, pending bet 410,420,430, 440,450,460,470,480,490,500; and (l') allowing each player in turn to participate in at least one round of placing bets 460,470,480,490,500 with one another, wherein step (l') 400' is performed between steps (e) 170 and (f) 180 or between steps (f) 180 and (f') 510, or to dispose of their card hand and lose at least one, preferably any and all, pending bet 410,420,430,440,450,460,470,480, 490, 500; and (m) allowing each player in turn to participate in at least one round of placing bets 460,470,480,490,500 with one another, wherein step (m) 530 is performed between steps (f') 510 and (g) 190, or to dispose of their card hand and lose at least one, preferably any and all, pending bet 410,420, 430,440, 450,460,470,480,490,500.

Figure 4:
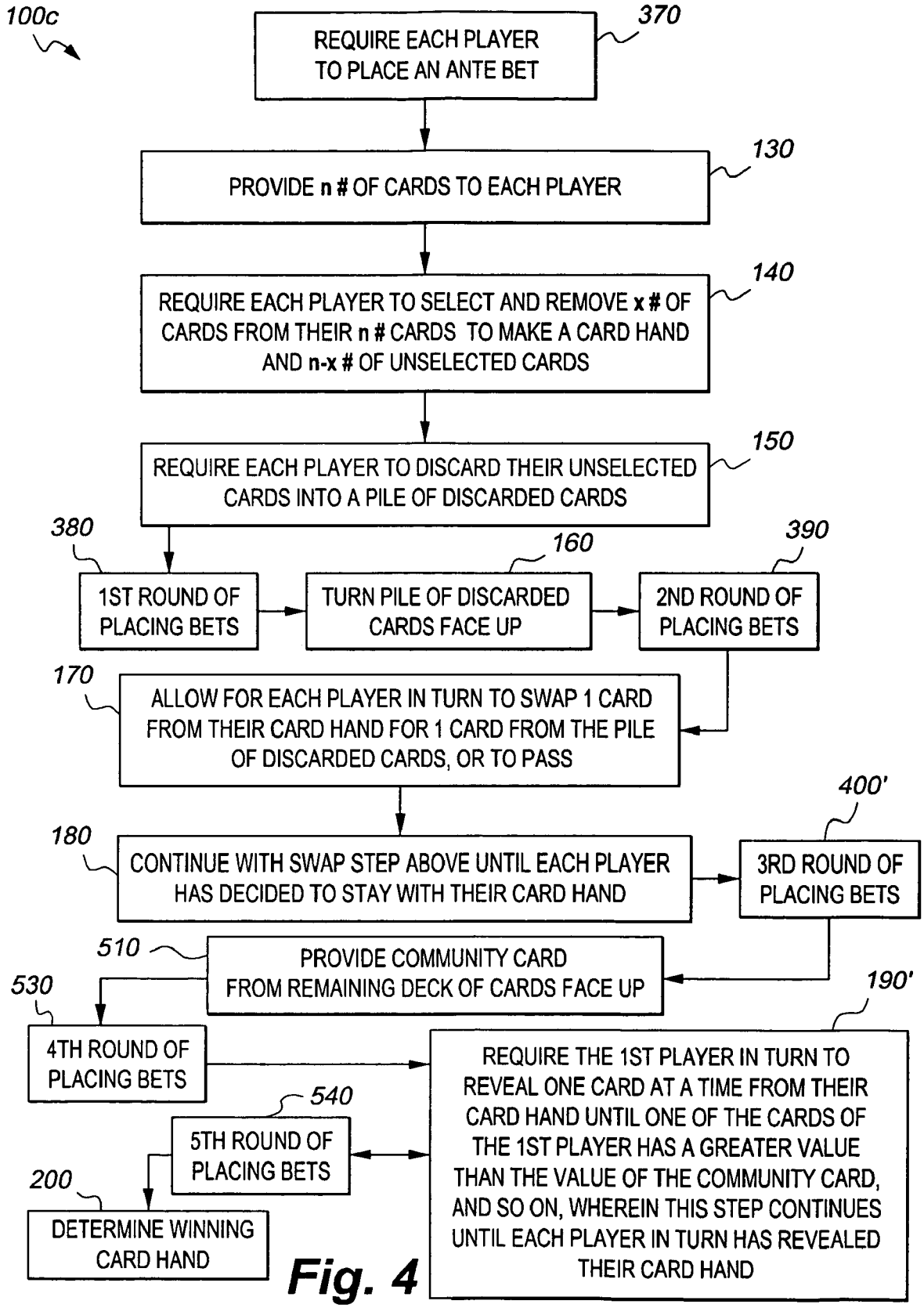
FIG. 4 shows a block diagram of an additional embodiment of the method of playing a card game, including a plurality of betting steps, according to the present invention.

Referring to FIGS. 1 and 4 and according to a third embodiment, the method 100*c* of playing a card game 110 differs from the method 100*b* of the second embodiment in that step (g) 190 of the second embodiment is replaced with step (g') 190' of the third embodiment. Step (g') 190' requires the first player in turn to reveal one card at a time from their card hand until one of the cards of the first player has a greater value than the value of the community card 520. The second player in turn is then required to reveal one card at a time from their card hand until one of the cards of the second player has a greater value than the value of the last revealed card of the first player, wherein step (g') 190' continues until each player in turn has revealed their card hand.

Thus, if wagering or betting is desired, the method 100*c* of playing a card game 110 of the third embodiment further includes at least one, preferably most or all, of the steps 370,380,390,400',530,540 of:

(i) requiring each player to place an ante bet 410,420, 430,440,450 prior to step (a) 130 for participation in the card game 110;

(j) allowing each player in turn to participate in at least one round of placing bets 460,470,480,490,500 with one another, wherein step (j) 380 is performed between steps (a) 130 and (b) 140, or between steps (b) 140 and (c) 150, or between steps (c) 150 and (d) 160, or to dispose of their card hand and lose at least one, preferably any and all, pending bet 410,420,430,440,450,460,470,480,490,500;

(k) allowing each player in turn to participate in at least one round of placing bets 460,470,480,490,500 with one another, wherein step (k) 390 is performed between steps (d) 160 and (e) 170, or to dispose of their card hand and lose at least one, preferably any and all, pending bet 410,420,430, 440,450,460,470,480,490,500;

(l') allowing each player in turn to participate in at least one round of placing bets 460,470,480,490,500 with one another, wherein step (l') 400' is performed between steps (e) 170 and (f) 180 or between steps (f) 180 and (f') 510, or to dispose of their card hand and lose at least one, preferably any and all, pending bet 410,420,430,440,450,460,470,480, 490,500;

(m) allowing each player in turn to participate in at least one round of placing bets 460,470,480,490,500 with one another, wherein step (m) 530 is performed between steps (f') 510 and (g') 190', or to dispose of their card hand and lose at least one, preferably any and all, pending bet 410,420, 430,440,450,460,470,480,490,500; and (n) allowing each player in turn to participate in at least one round of placing bets 460,470,480,490,500 with one another, wherein a round of placing bets is preferably performed after each card is revealed in step (g'), or to dispose of their card hand and lose at least one, preferably any and all, pending bet 410,420,430,440,450,460,470,480, 490,500.

In addition, each of the methods 100*a*,100*b*,100*c* of playing a card game 110 of all embodiments may further include the step of declaring a winning player for the entire game when a player is first to win a predetermined number (e.g., three or five) of card hands.

It is to be understood that the present invention is not limited to the embodiments described above, but encompasses any and all embodiments within the scope of the following claims.

What is claimed is:

1. A method of playing a card game starting with at least one deck of cards, the method comprising the steps of:

(a) providing n number of cards from a deck of cards to each of a plurality of players, wherein at least one of the n number of cards is provided face down to each player, further wherein once each player has been provided n number of cards from the deck of cards the remaining cards in the deck of cards are placed aside;

(b) requiring each player to select and remove x number of cards from their n number of cards wherein each player ends up with a preferred card hand of x number of selected cards and n−x number of unselected cards;

(c) requiring each player to discard their unselected cards, wherein the unselected cards of each player are in the face down position until all players have discarded their unselected cards to provide a pile of unselected cards;

(d) turning each card in the pile of unselected cards face up;

(e) allowing each player in turn to swap one card from their card hand for one card from the pile of face up unselected cards, or to pass, wherein each swapped card remains face down and unused or is turned face up and then treated as an unselected card available for swapping, wherein if a player passes the next player is allowed to pass or swap a card;

(f) continuing with step (e) until each player has decided to stay with their card hand;

(g) requiring each player to reveal their card hand; and (h) determining the winning card hand by a predetermined set of rules.

2. The method of playing a card game of claim 1, wherein the deck of cards comprises sixty-five cards of five different suits with thirteen cards in each suit, further wherein each card in each suit has a distinguishable numerical value and corresponding cards in the other suits, further wherein the cards in each suit have values in ascending order, and further wherein the winning card hand of step (h) is determined by a ranking order according to traditional poker rules.

3. The method of playing a card game of claim 1, wherein n is at least six.

4. The method of playing a card game of claim 3, wherein x is at least five.

5. The method of playing a card game of claim 1, wherein x is at least five.

6. The method of playing a card game of claim 1, wherein, in step (e), a player in turn can swap on any swapping turn even if that player passed on a previous swapping turn(s).

7. The method of playing a card game of claim 1, further comprising the step of: (f') providing a community card from the remaining deck of cards face up for simultaneous optional use by any or all of the players, wherein step (f') is performed between steps (f) and (g).

8. The method of playing a card game of claim 1, further comprising at least one of the steps of:

(i) requiring each player to place an ante bet prior to step (a) for participation in the card game;

(j) allowing each player in turn to participate in at least one round of placing bets with one another, wherein step (j) is performed between steps (a) and (b), or between steps (b) and (c), or between steps (c) and (d), or to dispose of their card hand and lose at least one pending bet;

(k) allowing each player in turn to participate in at least one round of placing bets with one another, wherein step (k) is performed between steps (d) and (e), or to dispose of their card hand and lose at least one pending bet; and (l) allowing each player in turn to participate in at least one round of placing bets with one another, wherein step (l) is performed between steps (e) and (f) or between steps (f) and (g), or to dispose of their card hand and lose at least one pending bet.

9. A method of playing a card game starting with at least one deck of cards, the method comprising the steps of:

(a) providing n number of cards from a deck of cards to each of a plurality of players, wherein at least one of the n number of cards is provided face down to each player, further wherein once each player has been provided n number of cards from the deck of cards the remaining cards in the deck of cards are placed aside;

(b) requiring each player to select and remove x number of cards from their n number of cards wherein each player ends up with a preferred card hand of x number of selected cards and n−x number of unselected cards;

(c) requiring each player to discard their unselected cards, wherein the unselected cards of each player are in the face down position until all players have discarded their unselected cards to provide a pile of unselected cards;

(d) turning each card in the pile of unselected cards face up;

(e) allowing each player in turn to swap one card from their card hand for one card from the pile of face up unselected cards, or to pass, wherein each swapped card remains face down and unused or is turned face up and then treated as an unselected card available for swapping, wherein if a player passes the next player is allowed to pass or swap a card;

(f) continuing with step (e) until each player has decided to stay with their card hand;

(f') providing a community card from the remaining deck of cards face up for simultaneous optional use by any or all of the players;

(g) requiring each player to reveal their card hand; and (h) determining the winning card hand by a predetermined set of rules.

10. The method of playing a card game of claim 9, wherein the deck of cards comprises sixty-five cards of five different suits with thirteen cards in each suit, further wherein each card in each suit has a distinguishable numerical value and corresponding cards in the other suits, further wherein the cards in each suit have values in ascending order, and further wherein the winning card hand of step (h) is determined by a ranking order according to traditional poker rules.

11. The method of playing a card game of claim 9, wherein n is at least six.

12. The method of playing a card game of claim 11, x is at least five.

13. The method of playing a card game of claim 9, wherein x is at least five.

14. The method of playing a card game of claim 9, wherein, in step (e), a player in turn can swap on any swapping turn even if that player passed on a previous swapping turn(s).

15. The method of playing a card game of claim 9, further comprising at least one of the steps of:

(i) requiring each player to place an ante bet prior to step (a) for participation in the card game;

(j) allowing each player in turn to participate in at least one round of placing bets with one another, wherein step (j) is performed between steps (a) and (b), or between steps (b) and (c), or between steps (c) and (d), or to dispose of their card hand and lose at least one pending bet;

(k) allowing each player in turn to participate in at least one round of placing bets with one another, wherein step (k) is performed between steps (d) and (e), or to dispose of their card hand and lose at least one pending bet;

(l') allowing each player in turn to participate in at least one round of placing bets with one another, wherein step (l) is performed between steps (e) and (f) or between steps (f) and (f'), or to dispose of their card hand and lose at least one pending bet; and (m) allowing each player in turn to participate in at least one round of placing bets with one another, wherein step (m) is performed between steps (f') and (g), or to dispose of their card hand and lose at least one pending bet.

16. A method of playing a card game starting with at least one deck of cards, the method comprising the steps of:

(a) providing n number of cards from a deck of cards to each of a plurality of players, wherein at least one of the n number of cards is provided face down to each player, further wherein once each player has been provided n number of cards from the deck of cards the remaining cards in the deck of cards are placed aside;

(b) requiring each player to select and remove x number of cards from their n number of cards wherein each player ends up with a preferred card hand of x number of selected cards and n−x number of unselected cards;

(c) requiring each player to discard their unselected cards, wherein the unselected cards of each player are in the face down position until all players have discarded their unselected cards to provide a pile of unselected cards;

(d) turning each card in the pile of unselected cards face up;

(e) allowing each player in turn to swap one card from their card hand for one card from the pile of face up unselected cards, or to pass, wherein each swapped card remains face down and unused or is turned face up and then treated as an unselected card available for swapping, wherein if a player passes the next player is allowed to pass or swap a card;

(f) continuing with step (e) until each player has decided to stay with their card hand;

(f') providing a community card from the remaining deck of cards face up for simultaneous optional use by any or all of the players;

(g') requiring the first player in turn to reveal one card at a time from their card hand until one of the cards of the first player has a greater value than the value of the community card of step (f'), wherein the second player in turn is then required to reveal one card at a time from their card hand until one of the cards of the second player has a greater value than the value of the last revealed card of the first player, wherein step (g') continues until each player in turn has revealed their card hand; and (h) determining the winning card hand by a predetermined set of rules.

17. The method of playing a card game of claim 16, wherein the deck of cards comprises sixty-five cards of five different suits with thirteen cards per each suit, further wherein each card in each suit has a distinguishable numerical value and corresponding cards in the other suits, further wherein the cards in each suit have values in ascending order, and further wherein the winning card hand of step (h) is determined by a ranking order according to traditional poker rules.

18. The method of playing a card game of claim 16, wherein n is at least six and x is at least five.

19. The method of playing a card game of claim 16, wherein in step (e), a player in turn can swap on any swapping turn even if that player passed on a previous swapping turn(s).

20. The method of playing a card game of claim 16, further comprising at least one of the steps of:

(i) requiring each player to place an ante bet prior to step (a) for participation in the card game;

(j) allowing each player in turn to participate in at least one round of placing bets with one another, wherein step (j) is performed steps (a) and (b), or between steps (b) and (c), or between steps (c) and (d), or to dispose of their card hand and lose at least one pending bet;

(k) allowing each player in turn to participate in at least one round of placing bets with one another, wherein step (k) is performed between steps (d) and (e), or to dispose of their card hand and lose at least one pending bet;

(l') allowing each player in turn to participate in at least one round of placing bets with one another, wherein step (l') is performed between steps (e) and (f) or between steps (f) and (f'), or to dispose of their card hand and lose at least one pending bet;

(m) allowing each player in turn to participate in at least one round of placing bets with one another, wherein step (m) is performed between steps (f') and (g'), or to dispose of their card hand and lose at least one pending bet; and (n) allowing each player in turn to participate in at least one round of placing bets with one another, wherein a round of placing bets is performed after at least one card is revealed in step (g'), or to dispose of their card hand and lose at least one pending bet.

* * * * *